US006739777B2

(12) United States Patent
Kobayashi et al.

(10) Patent No.: US 6,739,777 B2
(45) Date of Patent: May 25, 2004

(54) PRINTER AND ROLL-SHAPED PRINTING MEDIUM THEREFOR

(75) Inventors: Hikaru Kobayashi, Kanagawa (JP); Masahiro Uehara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/315,542

(22) Filed: Dec. 10, 2002

(65) Prior Publication Data

US 2003/0156883 A1 Aug. 21, 2003

(30) Foreign Application Priority Data

Dec. 14, 2001 (JP) ..... 2001-381843

(51) Int. Cl.[7] ..... B41J 11/26

(52) U.S. Cl. ..... 400/621; 400/621; 400/621.1; 400/611; 400/613

(58) Field of Search ..... 400/621, 621.1, 400/611, 613

(56) References Cited

U.S. PATENT DOCUMENTS 5,505,552 A * 4/1996 Hasegawa et al. ..... 400/621
5,556,213 A * 9/1996 Kudo et al. ..... 400/621
5,823,694 A * 10/1998 Ikegami ..... 400/621
5,913,624 A * 6/1999 Ikegami ..... 400/621
5,957,597 A * 9/1999 Kato ..... 400/621
6,113,294 A * 9/2000 Niwa ..... 400/621
6,142,688 A * 11/2000 Saito ..... 400/621
6,585,438 B2 * 7/2003 Hosokawa et al. ..... 400/621
6,648,532 B2 * 11/2003 Furuya et al. ..... 400/621

* cited by examiner

*Primary Examiner*—Andrew H. Hirshfeld
*Assistant Examiner*—Andrea H. Evans
(74) *Attorney, Agent, or Firm*—Robert J. Depke; Holland & Knight LLP

(57) ABSTRACT

A printer that uses a roll-shaped printing medium comprising a printing surface on which images are printed, a releasably adhered printing portion, and a release portion holding the adhered printing portion includes a conveying device conveying the printing medium while pulling out the printing medium by a predetermined amount every time an image is to be printed; a printing member printing an image with respect to the printing medium conveyed by the conveying device; a half-cutting unit cutting off the printing portion of the printing medium except for the release portion, along the conveying direction of the image printed by the printing member, at the interval corresponding to the dimension of the image in the width direction perpendicular to the conveying direction; and a cutting unit cutting the printing medium along the width direction, at the positions corresponding to the dimension of the aforementioned image in the conveying direction.

5 Claims, 11 Drawing Sheets

PRINTER AND ROLL-SHAPED PRINTING MEDIUM THEREFOR

This application claims priority to Japanese Patent Application Number JP2001-381843 filed Dec. 14, 2001, which is incorporated herein by reference.

BACKGROUND OF THE INVENTION

1. Field of the Invention

The present invention relates to a printer that uses a roll-shaped printing medium formed by winding, into a roll shape, a printing medium including a printing surface on which images are to be printed, a releasably adhered printing portion, and a release portion for holding the adhered printing portion. More particularly, the present invention relates to a printer capable of achieving precut seals in which a printing portion is cut for every image on a single release portion, while preventing the printing portion from peeling off before an image is printed thereon, and relates to a roll-shaped printing medium used for the same.

2. Description of the Related Art

Hitherto, in order to produce precut seals in which a seal portion alone is cut for every image on a single release paper by using a seal paper comprising a seal portion and a release paper, 4-divided (2×2) or 16-divided (4×4) cutting (half-cutting) has been applied in advance to only the seal portion of a seal paper cut into a fixed dimension, and thereafter a printing operation in keeping with this cutting has been performed.

In a printer using a roll-shaped seal paper formed by winding, into a roll shape, seal paper comprising a seal portion and a release paper, when precut seals are produced in the same manner as in the foregoing, the following problems occur.

One problem is that the seal portion peels off before printing.

Specifically, the half-cutting is performed also along the width direction perpendicular to the conveying direction, and hence, in the half-cut portion, the seal portion peels off at a portion near a roll core, the portion near the roll core having a large curvature. Therefore, the existing roll-shaped seal paper cannot be used as it is.

Another problem is that both the roll-shaped paper and the printer must have additional mechanisms.

Specifically, as described above, in order to produce precut seals, it is necessary to detect the position of the half-cut portion in the conveying direction, from a continuous roll-shaped seal paper, to thereby print an image, and therefore, an exclusive mechanism must be newly added. For example, as shown in FIG. 13, roll-shaped seal paper 91 has hitherto been provided with holes or markings 92 at regular intervals from the half-cut portion so that the position of the half-cut portion of the roll paper 91 in the conveying direction has been detected by reading the holes or markings by a sensor provided in the printer. This requires a change of the manufacturing process for roll paper, and also causes complication of the mechanism and control of the printer, resulting in increased costs of both roll paper and the printer.

SUMMARY OF THE INVENTION

Accordingly, it is an object of the present invention to solve these problems and to provide a printer that can prevent the printing portion from peeling off before an image is printed thereon, and that allows precut seals to be produced without the need to detect the position of the printing medium in the conveying direction, by using a roll-shaped printing medium formed by winding, into a roll shape, a printing medium comprising a printing surface on which an image is to be printed, a releasably adhered printing portion, and a release portion for holding the adhered printing portion, as well as to provide a roll-shaped printing medium used for the same.

In order to achieve the above-described object, the present invention provides a printer that uses a roll-shaped printing medium formed by winding, into a roll shape, a printing medium comprising a printing surface on which an image is to be printed, a releasably adhered printing portion, and a release portion for holding the adhered printing portion. This printer includes conveying device that conveys the printing medium while pulling out the printing medium by a predetermined amount every time an image is to be printed; a printing member that prints an image with respect to the printing medium conveyed by the conveying device; a half-cutting unit that cuts off the printing portion of the printing medium except for the release portion, along the conveying direction of the image printed by the printing member, at the interval corresponding to the dimension of the image in the width direction perpendicular to the conveying direction; and a cutting unit that cuts the printing medium along the width direction of the image printed by the printing member, at the positions corresponding to the dimension in the conveying direction.

By virtue of the described features, when a desired image is to be printed, the present printer conveys the roll-shaped printing medium while pulling out the printing medium by a predetermined amount every time the desired image is to be printed, and prints the desired image by the printing member with respect to the roll-shaped printing medium conveyed into a printing region. Either before or after the image is printed, the half-cutting unit cuts off the printing portion of the printing medium except for the release portion, along the conveying direction of the image printed by the printing member, at the interval corresponding to the dimension of the image in the width direction thereof. Thereafter, the cutter unit cuts the roll-shaped printing medium printed, along the width direction of the printed image, at the positions corresponding to the dimension of the image in the conveying direction thereof, thereby providing a print output.

The present printer further includes a second half-cutting unit disposed at the upstream side in the conveying direction of the cutting unit. This half-cutting unit cuts off the printing portion of the printing medium except for the release portion, along the width direction of the image printed by the printing member, at the positions corresponding to the dimension of the image in the conveying direction.

Thereby, the printing portion of the printing medium except for the release portion can be cut off not only along the conveying direction but also along the width direction of the printing portion.

The roll-shaped printing medium according to the present invention is used for a printer that prints images with respect to the conveyed printing medium. This roll-shaped printing medium includes a printing surface on which images are to be printed, a printing portion that is releasably adhered, and a release portion for holding the adhered printing portion. In this printer, the printing portion has been cut off in advance along the conveying direction of the image printed by the printing member, at the interval corresponding to the dimension of the image in the width direction perpendicular to the conveying direction.

With these features, when precut seals are produced, it becomes unnecessary for the printer to detect the position of the printing medium in the conveying direction thereof.

The above and other objects, features, and advantages of the present invention will become clear from the following detailed description of the preferred embodiments of the invention in conjunction with the accompanying drawings.

DESCRIPTION OF THE PREFERRED EMBODIMENTS

Hereinafter, the embodiments according to the present invention will be described with reference to the accompanying drawings.

Figure 1:
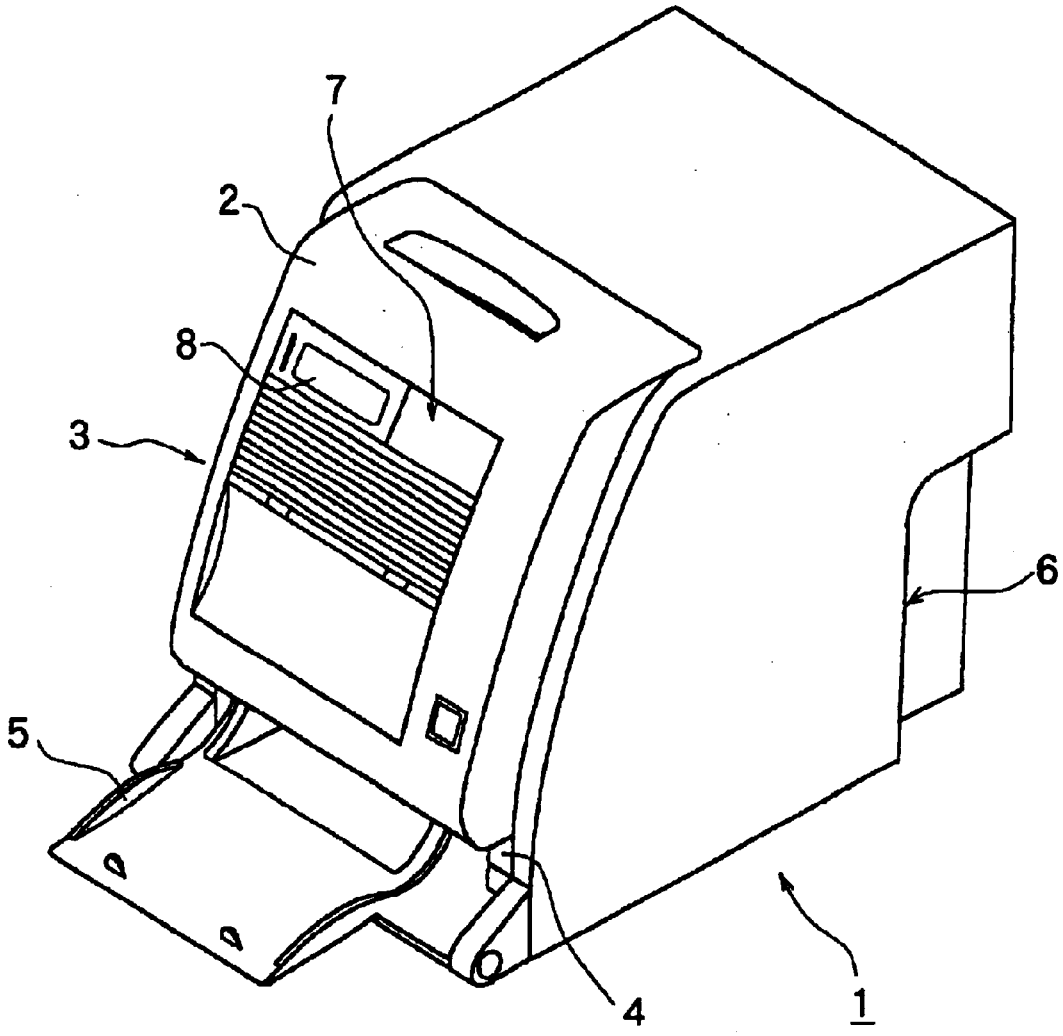
FIG. 1 is an overall perspective view showing a printer according to a first embodiment of the present invention.

FIG. 1 is an overall perspective view showing a printer according to a first embodiment of the present invention. This printer is a so-called "heat transfer type color printer", and uses a roll-shaped printing medium formed by winding a printing medium into a roll shape. In the descriptions below, the roll-shaped printing medium (such as roll paper for use in seals or labels) comprising a printing surface on which images are to be printed, a releasably adhered printing portion (hereinafter referred to as a "seal portion"), and a release portion (hereinafter referred to as a "release paper") for holding the adhered printing portion, is simply referred to as a "roll paper".

Referring to FIG. 1, in this color printer 1, a door portion 3 with a door panel 2 affixed thereto, a power switch 4, and a paper discharge tray 5 are provided on the front surface side thereof, and a connector connecting portion 6 comprising a plurality of connecters for external connection are provided on the rear surface side thereof.

The door portion 3 is pivotally supported by the cabinet of the printer body at the lower portion thereof, and is opened/closed when roll paper or ink ribbons are exchanged. Also, as can be seen from FIG. 1, the door panel 2 includes an operation panel 7 with which various operations are made and a display portion 8 for displaying various messages.

Figure 2:
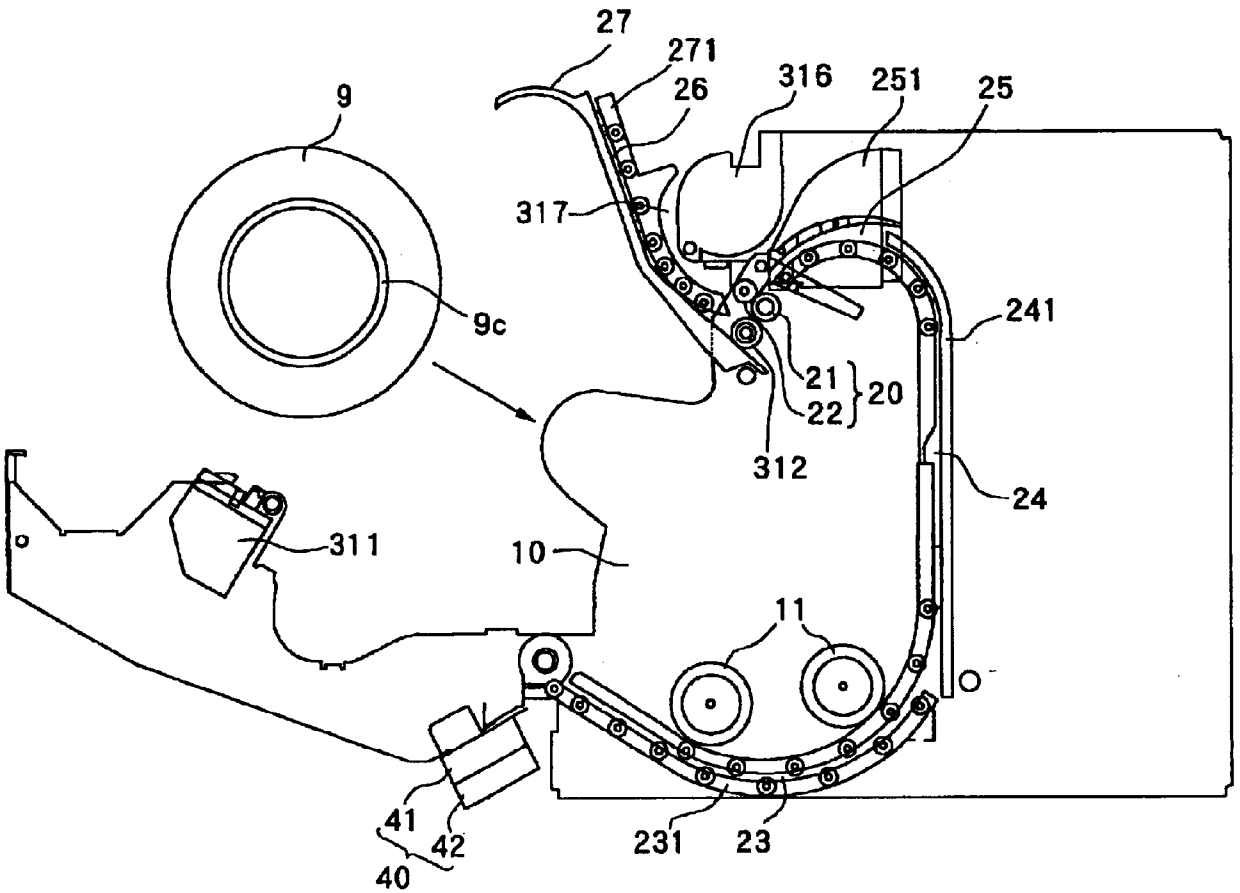
FIG. 2 is a cross sectional view illustrating the internal construction of the printer shown in FIG. 1, wherein a door portion and an internal door are opened.
Figure 3:
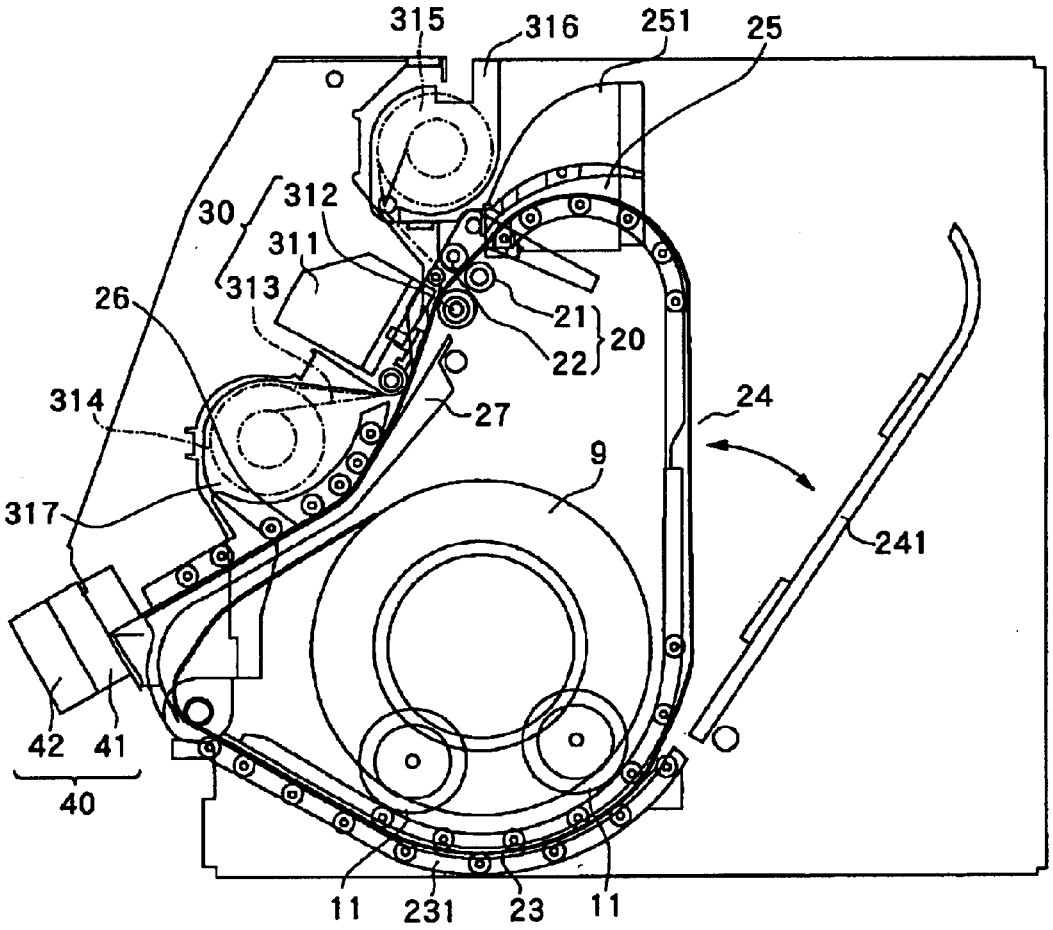
FIG. 3 is a cross sectional view illustrating the internal construction of the printer shown in FIG. 1.

FIGS. 2 and 3 are cross sectional views illustrating the internal construction of the color printer 1.

Referring to FIGS. 2 and 3, the printer 1 comprises a roll paper accommodating section 10 in which roll paper 9 is set, conveying means 20 for conveying the roll paper 9, printing means 30 for printing images on the roll paper conveyed, a cutting unit 40 for cutting the roll paper 9, and a control section (not shown). Upon receipt of a print start instruction, the control section outputs a predetermined control signal to the conveying means 20, the printing means 30, and the cutting unit 40 according to the image to be printed, in order to obtain a desired print output.

The roll paper accommodating section 10 is a portion in which the roll paper 9 is accommodated as a printing medium, and as can be seen from FIG. 3, occupies the major portion of the space within the printer. A pair of turnable support roller 11 are provided at lower portions of opposite sides of the roll paper accommodating section, and these support rollers turnably support the roll core 9*c* of the accommodated roll paper 9. Here, the setting of the roll paper 9 is performed with the door portion 3 and an inner door 27 brought into an opened state.

The conveying means 20 conveys the roll paper 9 through conveying paths 23 to 26 described later, ranging from the roll paper accommodating section 10 (upstream side) down to the paper discharge tray 5 (downstream side), while performing, as required, delivery and pulling-back of the roll paper 9 upon receipt of the control signal from the control section. In this embodiment, a pulse motor (not shown) is used as a main body drive motor (main motor), and the delivery amount and the pulling-back amount of the roll paper 9 are set by counting the number of pulses of the pulse motor.

The conveying means 20 is disposed on the upper side of the front surface within the printer, and comprises a capstan roller 21, a pinch roller opposed thereto, and drive means (not shown) for driving the capstan roller 21. For the capstan roller 21, minute anti-slip protrusions for preventing slips between the roll paper 9 and the capstan roller 21 are formed over the entire circumference of the capstan roller 21. The pinch roller 22 is configured to be movable in the pressing direction and the leaving direction with respect to the capstan roller 21.

The conveying paths through which the roll paper 9 is conveyed by the conveying means 20 are broadly classified into a lower-side conveying path 23, a rear-side conveying path 24, an upper-side conveying path 25, and a front-side conveying path 26. The lower-side conveying path 23 is one located directly behind the roll paper accommodating section 10, and is formed of the lower outer-peripheral surface of the roll paper accommodating section 10, and a lower-side guide 231 disposed with a predetermined gap therebetween. The rear-side conveying path 24 is formed of the rear outer-peripheral surface (rear surface portion) of the roll paper accommodating section 10, and a movable guide 241 the lower side of which is pivotally supported by the cabinet and that is turnable frontward and rearward. The upper-side conveying path 25 is formed of the upper outer-peripheral surface of the roll paper accommodating section 10, and an upper-side guide 251 having a skew correcting function. The front-side conveying path 26 is formed of the inner door 27 the upper side of which is pivotally supported by the cabinet and that is rotatable frontward and rearward, and a paper discharge guide 271 disposed on the inner door 27 with a predetermined gap therebetween, and this front-side conveying path 26 ultimately leads the roll paper 9 to the paper discharge tray 5.

The printing means 30 prints a desired image on the printing porting of the roll paper 9 upon receipt of a control signal from the control section.

The printing means 30 is disposed on the downstream side of the conveying means 20, and comprises a thermal head 311, a platen 312 rotatably disposed on the position opposed thereto, and an ink ribbon 313. The ink ribbon 313 is set by accommodating the take-up reel 314 and delivery reel 315 thereof in a take-up reel accommodating section 317 provided in the inner door 27 and a delivery reel accommodating section 316 provided in the cabinet, respectively.

The cutting unit 40 comprises half-cutting means 41 that, making use of the force by which the roll paper 9 is conveyed, cuts off the seal portion alone of the roll paper 9 along the conveying direction, at a predetermined interval, while leaving the release paper as it is without cutting off it (hereinafter this is referred to as "half-cutting"); and cutting means 42 that is disposed on the downstream side of the half-cutting means 41 in the conveying direction and that cuts the roll paper 9 along the width direction perpendicular to the conveying direction.

Figure 4:
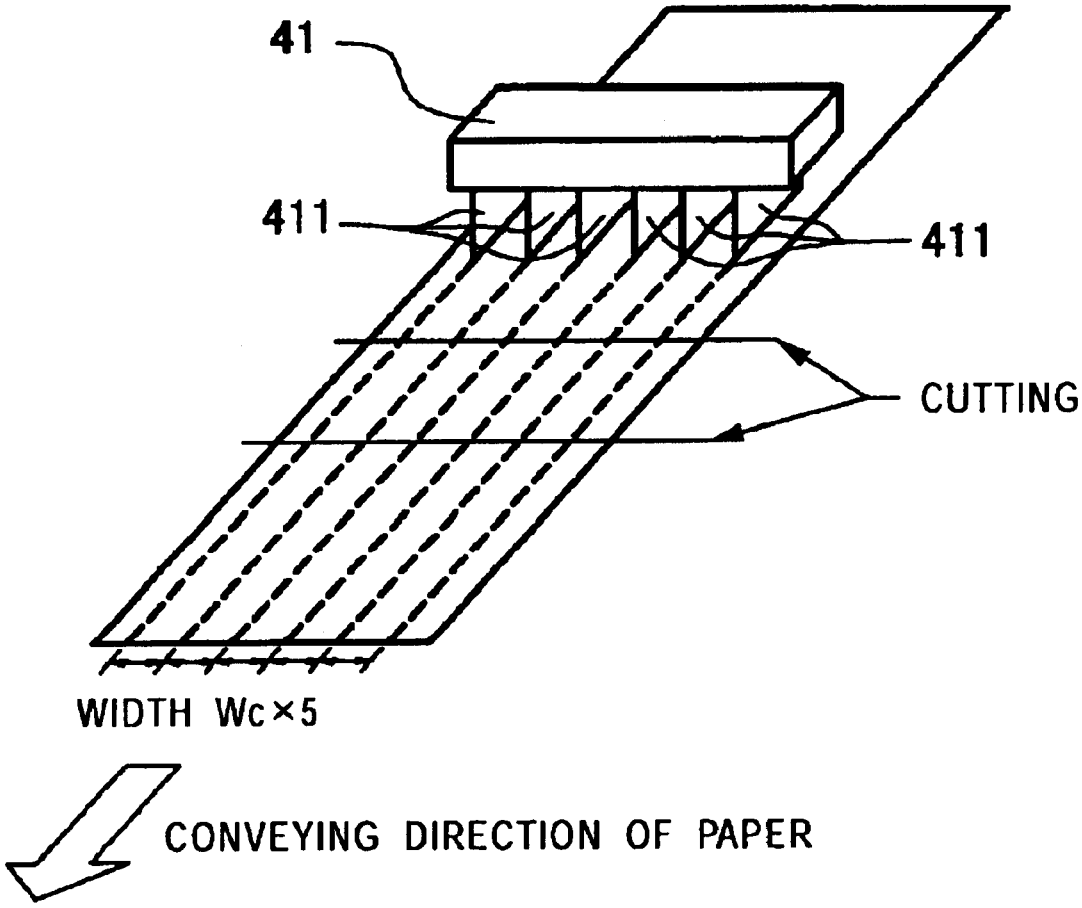
FIG. 4 is a schematic perspective view of half-cutting means of this embodiment.
Figure 5B:
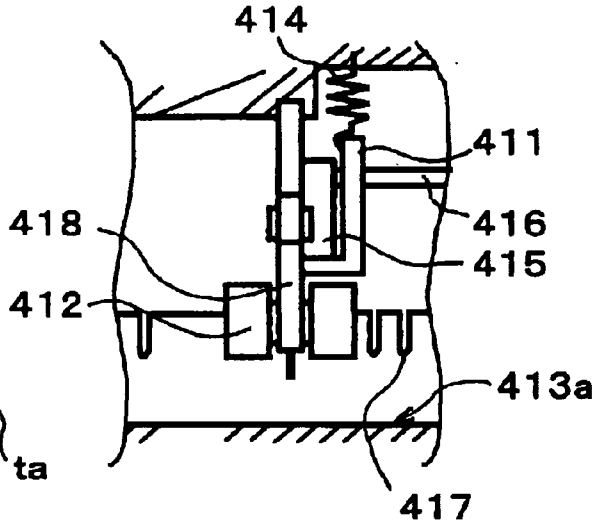
FIGS. 5A and 5B are schematic views illustrating the main internal construction of the half-cutting means shown in FIG. 4.
Figure 5A:
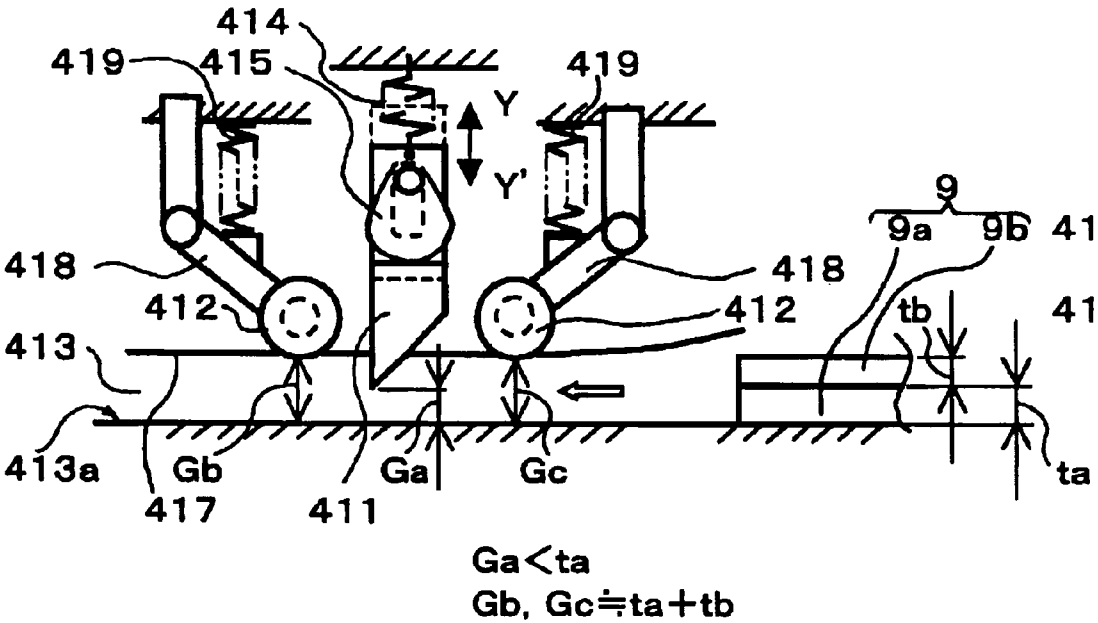

As shown in FIG. 4, the half-cutting means 41 has a plurality of cutters 411 with a predetermined interval Wc provided in the width direction. On the upstream side and the downstream side of these cutters 411 in the conveying direction, there are provided a pair of pressing rollers 412, as shown in FIGS. 5A and 5B.

The cutters 411 are movable vertically (as indicated by the arrows Y–Y' in FIG. 5A) independently of one another. They are arranged, during usage, to move down to the descent position such that the gap Ga between the lower-side surface 413*a* (hereinafter referred to as a "conveying surface") of the conveying path 413 and the cutters 411 becomes somewhat smaller than the thickness ta of the release paper 9*a* of the roll paper 9, that is, such that a conditional expression: (0<Ga<ta) is satisfied. On the other hand, during nonusage, they are arranged to be evacuated from the conveying path 413 of the roll paper 9.

The pressing rollers 412 are arranged to press the roll paper 9 conveyed, and thereby prevent the roll paper 9 from lifting off from the conveying surface 413*a*. They are configured, during usage, so that the gaps Gb and Gc between the conveying surface 413*a* and the respective pressing rollers 412 become substantially the same as the overall thickness of the roll paper 9, namely, (the thickness tb of the seal portion 9*b* +the thickness ta of the release paper 9*a*), that is, so that the conditional expression (Gb, Gc tb+ta) is satisfied.

Figure 6A:
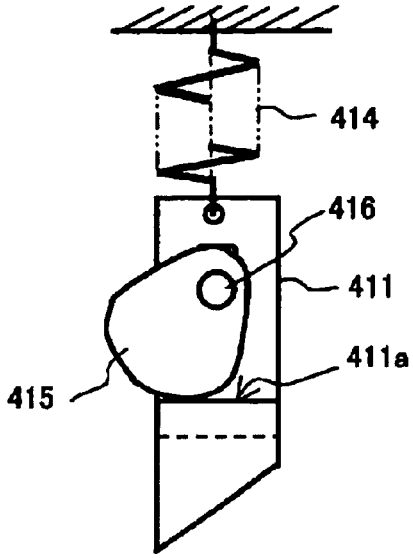
FIGS. 6A and 6B are representations of the constructions of the cutter of the half-cutting means and a cam vertically moving the cutter.
Figure 6B:
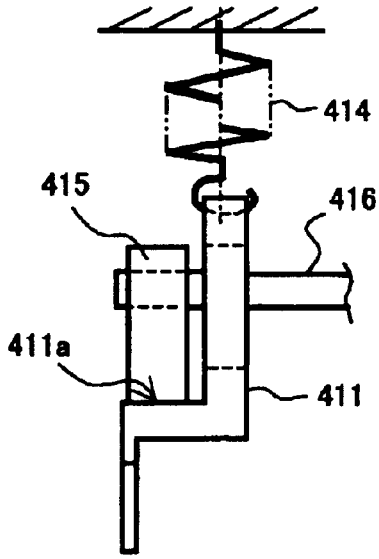

More specifically, as shown in FIG. 6A, the cutter 411 are formed into a bent shape, and are resiliently urged upward by an elastic member (e.g., a tension spring) 414. Also, a cam 415 for pressing downward the bent portions 411*a* of the cutters 411 is fixed to a rotating shaft 416.

Figure 7:
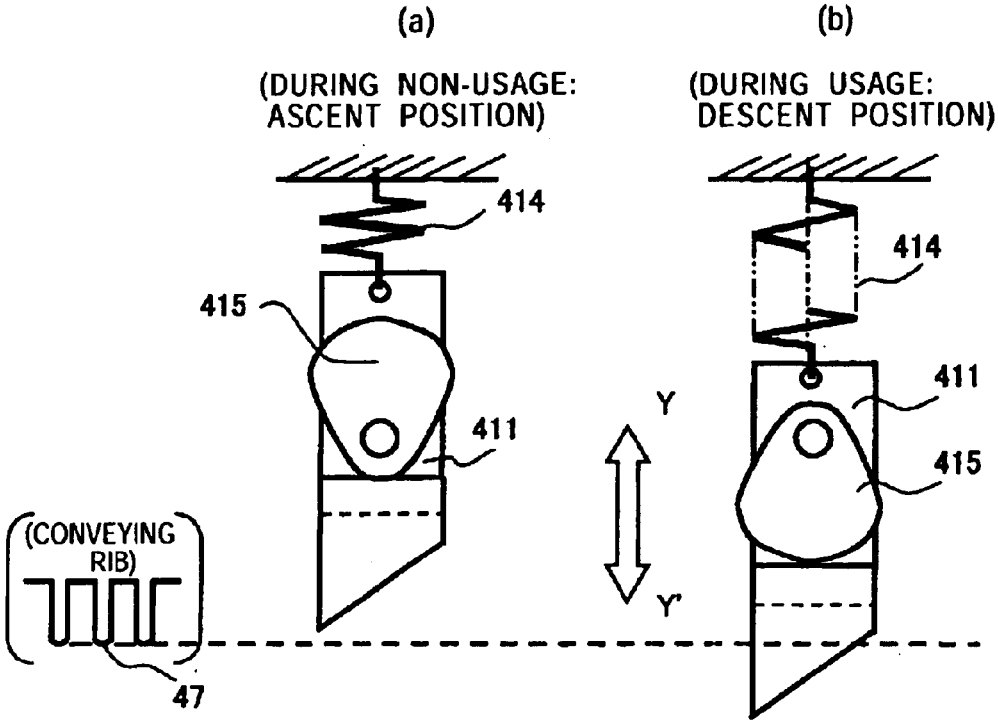
FIGS. 7A and 7B are representations explaining vertical movements of the cutter of the half-cutting means.

During non-usage, the cutters 411 are evacuated at a position where they do not project from conveying ribs 417 that form the upper side of the conveying path of the roller paper 9 (see FIG. 7A). On the other hand, during usage, the aforementioned rotating shaft 416 is rotationally driven upon receipt of a signal from the control section, thereby moving the cutters 411 down to the aforementioned descent position via the cam 415 (see FIG. 7*b*).

The pressing rollers 412 are each rotatably supported by a support arm 418 that is rotatably provided, and is resiliently urged downward by an elastic member (e.g., a compression spring) 419 via the support arm 418, in order to prevent the pressing roller 412 from interfering with the conveyance, while accommodating to variations of the thickness (tb+ta) of the roll paper 9 (see FIGS. 5A and 5B).

Figure 8A:
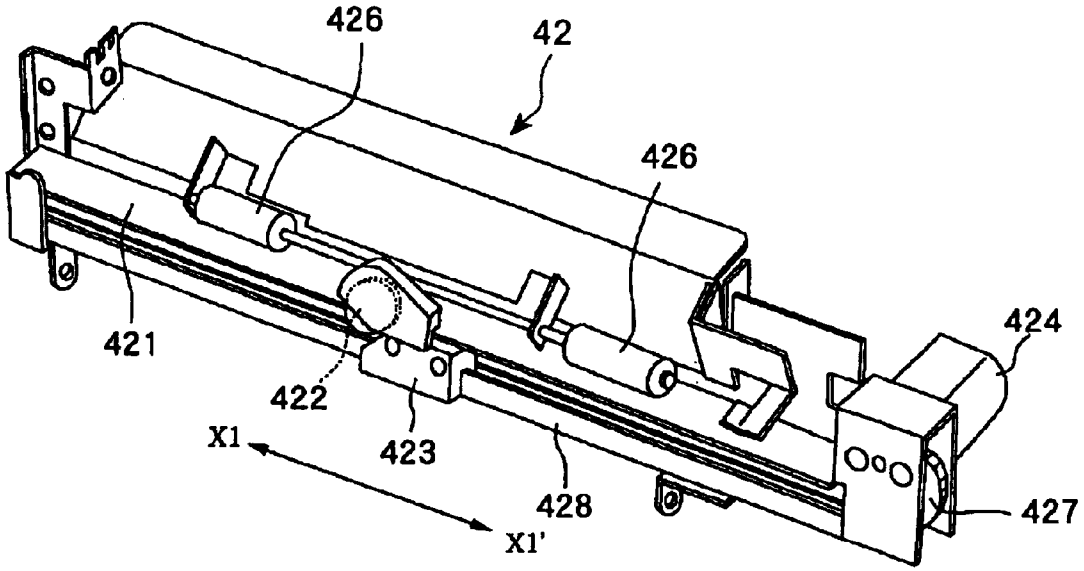
FIGS. 8A and 8B are representations explaining the construction of the cutting means of this embodiment.
Figure 8B:
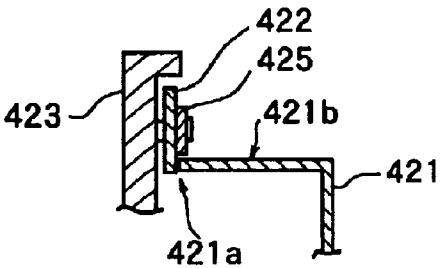

The cutting means 42 is arranged to cut the roll paper 9 on which an image has been printed, at a position apart from the printed image by a predetermined distance, this position being counted by the number of pulses using the aforementioned pulse motor. As shown in FIGS. 8A and 8B, the cutting means 42 comprises an L-type fixed cutter 421 that is fixed along the width direction and over which the roll paper 9 is conveyed, a carriage 423 that is provided so as to be movable along the width direction and that has a rotating cutter 422 affixed thereto, and a drive motor 424 for driving the carriage 423. During non-usage, the carriage 423 is located outside the conveying paths of the roll paper 9.

The rotating cutter 422 is disposed so that one surface side thereof is brought close to the front end portion 421*a* of the fixed cutter 421, and on this surface side, an annular member 425 formed of a material, such as rubber, having a large friction coefficient, is affixed so as to be coaxial with the rotating cutter 422 and so that the peripheral surface thereof abuts against the top surface 421*b* of the fixed cutter 421.

On the upstream side of the fixed cutter 421, a pair of pressing rollers 426 are provided along the width direction, and presses the roll paper 9 conveyed by the energization force of an elastic member (not shown), in a downward direction, i.e., to the fixed cutter 421 side. Here, a timing spool (not shown) is integrally formed with a gear 427 meshing with a gear (not shown) affixed to the output shaft of the aforementioned drive motor 424. A timing belt 428 is looped over this timing spool and another timing spool (not shown) at the opposite end side of this timing spool.

When the drive motor 424 is driven upon receipt of a signal from the control section, the timing belt 428 is also driven, thereby moving the carriage 423 in the width direction (the X1 and X1' directions indicated in FIG. 8A).

Next, the operation of the printer 1 with the above-described features will be described below.

After the roll paper 9 has been set to the state in which the front end thereof is abutted against the inner door 27, when the inner door 27 is closed, the pinch roller 22 is driven to press onto the capstan roller 21 via the roll paper 9. Thereafter, the movable guide is driven into an opened state. The purpose for this is to absorb the looseness of the roll paper 9 caused by pulling-back thereof. Then, the capstan roller 21 is driven to convey the roll paper 9, and the cutting means 42 is driven to remove a predetermined amount of the front end of the roll paper 9 that might get soiled when the roll paper 9 is set, thereby providing an initialization state.

Upon receipt of an print start instruction, the capstan roller 21 is driven to pull back the roll paper 9 of which the front end is placed on the cutting unit 42, up to the printing region, and the take-up reel 314 is driven to perform cuing of the ink ribbon 313, thereby setting the ink ribbon 313 to a predetermined state.

Then, after being superimposed on the roll paper 9, the ink ribbon 313 is conveyed while being pressed onto the aforementioned platen 312, and transfers ink to the paper roll 9 by being heated by the above-mentioned thermal head 311, thus performing printing. Here, the roll paper 9 reciprocates three (or four) times on the printing region because the printing is performed by sequentially superimposing ink ribbons 313 of yellow (Y), magenta (M), and cyan (C), or in some case, additionally an ink ribbon 313 of laminate (L), on the roll paper 9.

When the above printing operation has been completed, the capstan roller 21 is driven to convey the roll paper 9 up to the half-cutting means 41. Herein, when half-cutting is to be applied to the roll paper, the aforementioned predetermined cam 415 of the half-cutting means has also been driven, and the cutters 411 at the positions corresponding to the dimension of the printed image in the width direction has moved down to the above-described descent position.

Thereby, when passing through the half-cutting means 41, the roll paper is subjected to half-cutting along the conveying direction, at the interval corresponding to the dimension of the image in the width direction. Specifically, if the printed image is one, half-cutting is applied to the opposite ends of the image in the width direction, i.e., to the left and right ends thereof. If there is a plurality of the same or mutually different printed images, half-cutting is applied to the left and light ends of each of the images.

Thereafter, the roll paper 9 is conveyed up to the cutting means 42, and is cut along the width direction, at each of the positions corresponding to the dimension of the printed image in the conveying direction (i.e., the position corresponding to the front end or the rear end of the image), by driving the drive motor 424 of the cutting means 42, and then, a print output is discharge to the paper discharge tray 5. This makes it possible to produce precut seals in which half-cutting is performed along the conveying direction for every image on a single release paper.

In the foregoing descriptions, although the half-cutting means 41 was disposed on the downstream side of the printing means 30 in the conveying direction, the half-cutting means 41 may instead be disposed on the upstream side of the printing means 30.

Next, a second embodiment according to the present invention will be described below. This embodiment is different from the first embodiment in that half-cutting is performed also along the width direction.

Figure 9:
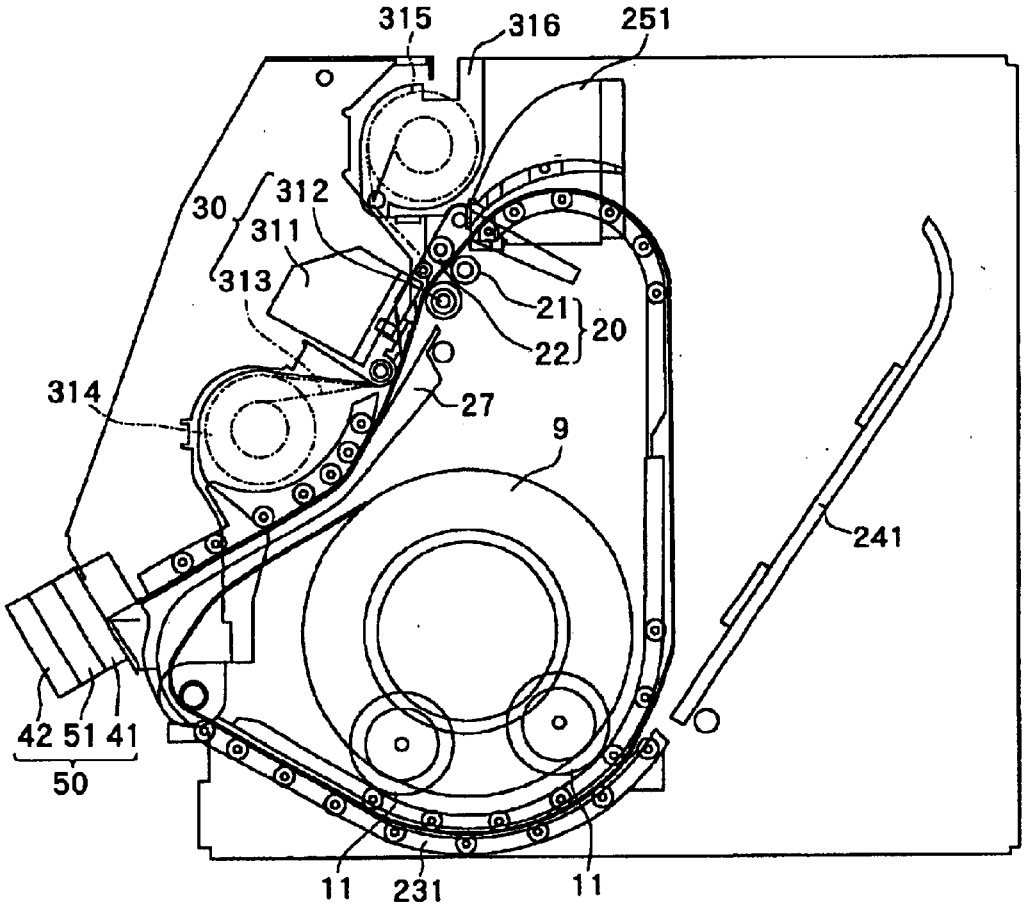
FIG. 9 is a cross sectional view illustrating the internal construction of a printer according to a second embodiment of the present invention.

Specifically, as shown in FIG. 9, instead of the cutting unit 40 in the first embodiment, another cutting unit 50 is provided. This cutting unit 50 includes a second half-cutting means 51 that performs half-cutting along the width direction, and that is disposed between the half-cutting means 41 and the cutting means 42, i.e., on the upstream side of the cutting means 42 in the conveying direction, and is configured to cut the roll paper 9 after half-cutting has been applied along the conveying direction and the width direction. However, the second half-cutting means 51 and the cutting means 42 are arranged to be selectively driven with respect to an image.

Because the configurations in this embodiment, other than the second half-cutting means 51 are the same as those in the first embodiment, the descriptions thereof are omitted hereinafter.

Figure 10A:
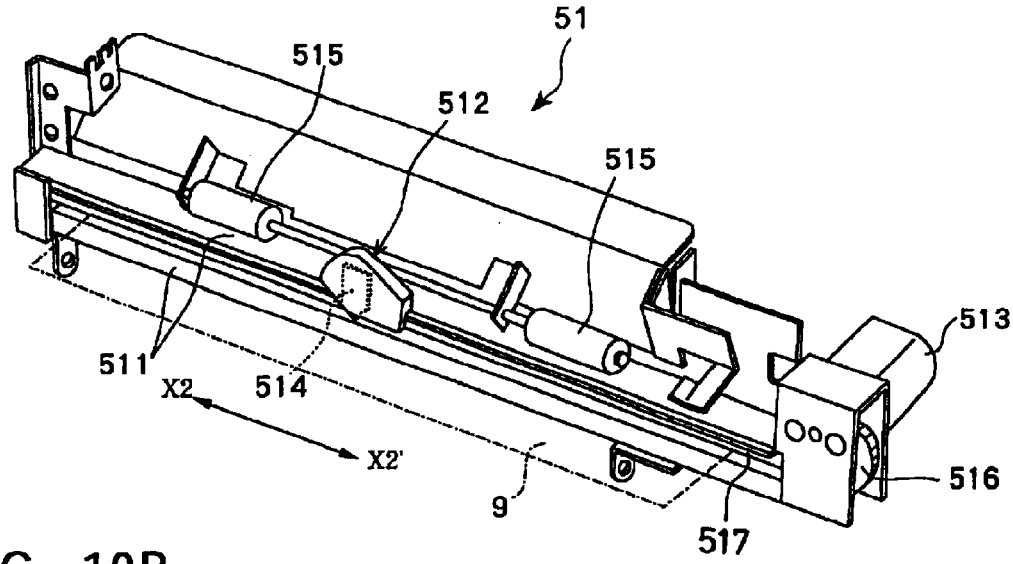
FIGS. 10A and 10B are representations of the construction of second half-cutting means of the second embodiment.
Figure 10B:
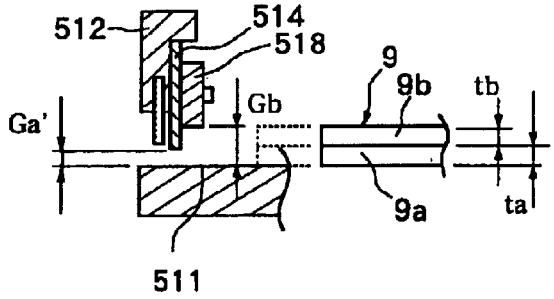

As shown in FIG. 10, the second half-cutting means 51 comprises a conveying surface 511 for the roll paper 9, a carriage 512 provided so as to be movable along the width direction, and a drive motor 513 for driving the carriage 512. During non-usage, the carriage 512 is located outside the conveying paths of the roll paper 9.

For the carriage 512, in order to be adaptable to either of the moving directions of the carriage 512, a two-edged cutter 514 having edges on both sides in the width direction is fixed at the position such that the gap Ga' between the conveying surface 511 and the two-edged cutter 514 becomes smaller than then thickness ta of the release paper 91 of the roll paper 9, that is, such that a conditional expression: ($0<Ga'<ta$) is satisfied.

At the position adjacent to the two-edged cutter 514, there is rotatably provided an annular member 518, and the annular member 518 is configured so that the gap Gd between the peripheral surface thereof and the conveying surface 511 become substantially the same as the overall thickness of the roll paper 9, namely, (the thickness tb of the seal portion 9*b* +the thickness ta of the release paper 9*a*), that is, so that a conditional expression: ($Gd \approx tb+ta$) is satisfied. Thereby, it is possible, during operation, to prevent falling of the two-edged cutter 514 and maintain it in an appropriate state, while pressing the roll paper 9.

Furthermore, on the upstream side of the carriage 512, a pair of pressing roller 515 are provided along the width direction, and presses the roll paper 9 conveyed by the energization force of an elastic member (not shown), in a downward direction, i.e., to the conveying surface 511 side. Here, a timing spool (not shown) is integrally formed with a gear 516 meshing with a gear (not shown) affixed to the output shaft of the drive motor 513. A timing belt 517 is looped over this timing spool and another timing spool (not shown) at the opposite end side of this timing spool.

When the drive motor 513 is driven upon receipt of a signal from the control section, the timing belt 517 is also driven, thereby moving the carriage 512 in the width direction (the X2 and X2' directions indicated in FIG. 10A).

Specifically, according to the printer of this embodiment, when half-cutting according to the printed image is to be applied to the roll paper 9 along the conveying direction and the width direction, upon receipt of a signal from the control section, the half-cutting means is driven, at a predetermined timing before or after image printing by the printing means 30, to perform half-cutting along the conveying direction, at the interval corresponding to the dimension of the printed image in the width direction. Thereafter, the above-described second half-cutting means 51 is driven, at a predetermined timing, to perform half-cutting along the width direction, at the positions corresponding to the dimension of the printed image in the conveying direction. Thereby, even if there is a plurality of the same or mutually different printed images along the width direction, half-cutting is performed with respect to the front and rear ends and the left and right ends of each of the images.

When the roll paper 9 is to be cut without performing half-cutting along the width direction upon receipt of a signal from the control section, the cutting means 42 is driven, at a predetermined timing, to cut the roll paper 9 in the width direction, at the positions corresponding to the dimension of the image in the conveying direction, without driving the second half-cutting means 51. This makes it possible to produce precut seals in which half-cutting is performed along the conveying direction and the width direction, that is, with respect to the front and rear ends and the left and right ends of the image, for every image on a single release paper.

Here, the arrangement of the second half-cutting means 51 is not limited to one described above. For example, the arrangement thereof may be such that cutters corresponding to the dimension of the roll paper 9 in the width direction is provided so as to be vertically movable, and that half-cutting along the width direction is performed by pressing these cutters downward.

Meanwhile, in the foregoing descriptions, a heat transfer type color printer is used. However, a black and white printer may be used, or another type of printer such as an ink jet printer may also be used. Furthermore, it is to be understood that the arrangement of each of the means described above is illustrative and not restrictive.

Next, references will be made to the embodiment of the roll-shaped printing medium according to the present invention.

Figure 11:
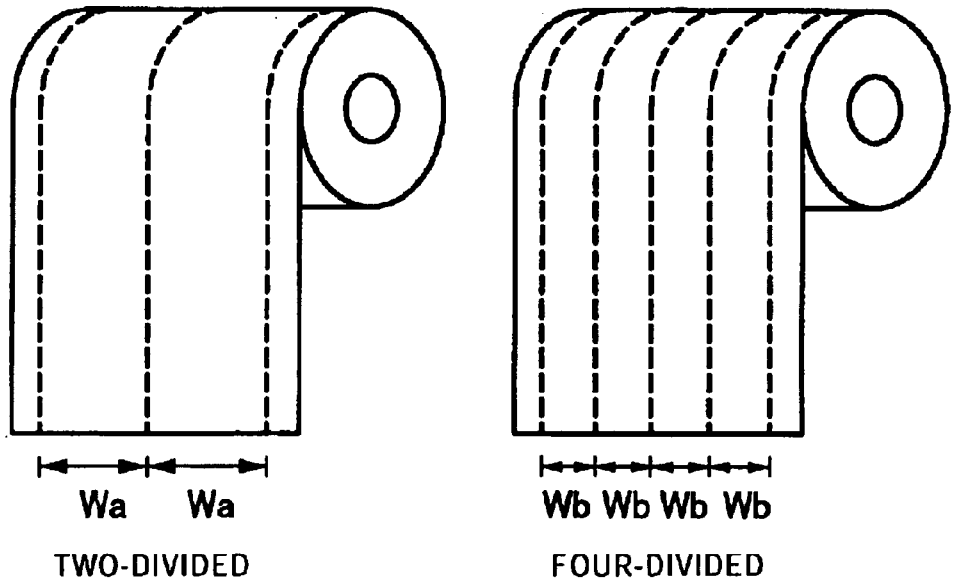
FIG. 11 is representation of examples of roll paper according to the present invention.

This roll-shaped printing medium is one formed by performing half cutting in advance along the conveying direction of an image printed by the printer, at the interval corresponding to the dimension in the width direction of the image. That is, since the dimension of an image to be printed in the width direction is predetermined, half-cutting is applied to the roll paper 9 in advance according to the width or interval thereof. For example, as shown in FIG. 11, with respect to the roll paper 9 used for a printer that prints 2-divided images, half-cutting at the interval corresponding to a 2-divided image width Wa, is applied, while, with respect to the roll paper 9 used for a printer that prints 4-divided images, half-cutting corresponding to a 4-divided image width Wb, is applied. Out of these types of roll paper 9, a desired type of roll paper can be appropriately selected according to the used printer, consequently the image to be printed.

In such types of roll paper 9, half-cutting is performed with respect to the conveying direction alone, and with respect to the width direction, the roll paper 9 has only to be cut according to the printed image as in the case of ordinary printing operation. Therefore, it is unnecessary to detect the position of the roll paper 9 in the conveying direction for printing. In addition, since the peeling-off of the seal portion before printing can be prevented, it is possible to produce precut seals with ease and reliability.

Figure 12:
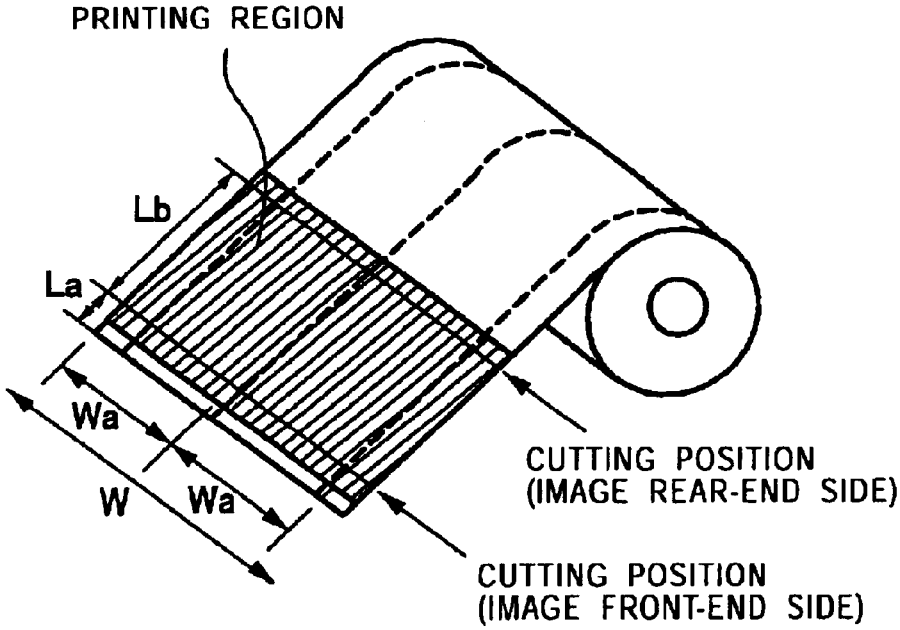
FIG. 12 is a representation of an example of precut seals produced by using roll paper according to the present invention.
Figure 13:
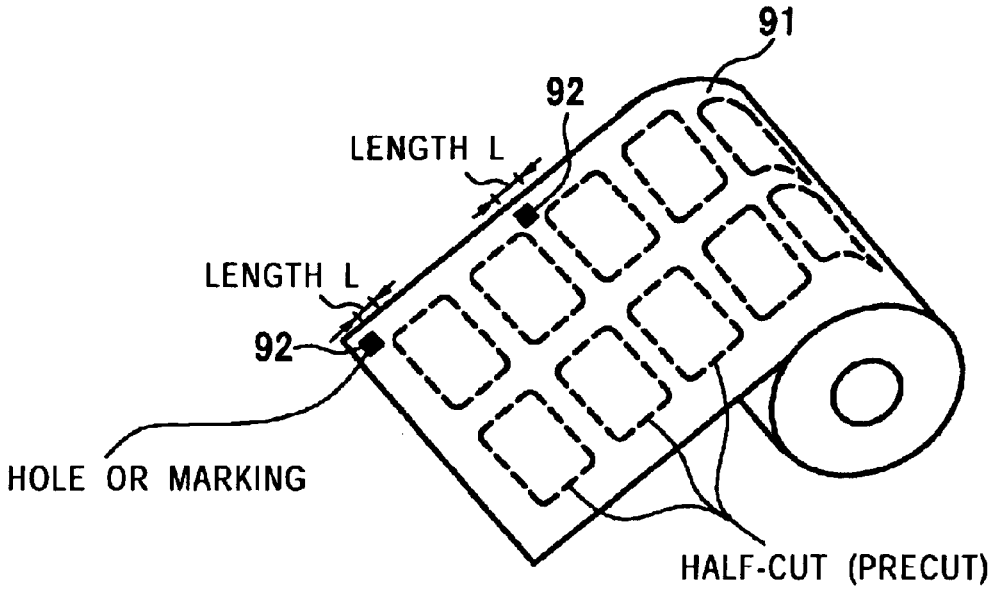
FIG. 13 is a representation of conventional roll paper for producing precut seals.

For example, as shown in FIG. 12, when precut seals for 2-divided images is to be obtained, the roll paper that is subjected in advance to half-cutting for 2-divided images, is used as a printing medium for a printer, and images (2-divided images) are printed on this roll paper. With regard to the conveying direction, the roll paper 9 is cut, with reference to the printed image, at the position apart from the front end of the roll paper 9 by a distance of La (i.e., the front end side of the image), and at the position apart from the cutting line on this front end side of the image by a distance of Lb (i.e., the rear end side of the image), the La portion overlapping with the printing region.

The above-described method eliminates the need to accurately detect the half-cutting position in the width direction when printing an image, unlike the case where the roll paper is subjected to half-cutting also along the width direction. This saves a mechanism (sensor or the like) for accurately detecting the half-cutting position in the width direction, and reliably prevents the possibility that the seal portion peels off before printing.

As is evident from the foregoing, according to the printer of the present invention, the printing medium is conveyed by the conveying means while pulling out the printing medium by a predetermined amount every time an image is to be printed; an image is printed by the printing means with respect to the printing medium conveyed by the conveying device; the printing portion of the printing medium except for the release portion is cut off by the half-cutting unit along the conveying direction of the image printed by the printing member, at the interval corresponding to the dimension of the image in the width direction perpendicular to the conveying direction; and the printing medium is cut by the cutting means along the width direction of the printed image, at the positions corresponding to the dimension of the image in the conveying direction. This makes it possible to produce precut seals in which the printing portion is cut off on the release portion according to the dimension of the printed image in the width direction, by using the roll-shaped printing medium that is not subjected to half-cutting in advance. In particular, since it is not necessary to use a roll-shaped printing medium that is half-cut in the width direction, an arrangement or a control for detecting the position of the roll-shaped printing medium in the conveying direction is not required to be newly provided. This prevents the cost increase due to the production of precut seals, and reliably inhibits the printing portion from peeling off before printing.

Also, according to the printer of the present invention, even if there is a plurality of images printed by the printing mean along the width direction, half-cutting is performed in the conveying direction at the interval corresponding to the dimension of each image in the width direction. Thereby, it is possible to produce precut seals in which the printing portion is subjected to half-cutting along the conveying direction for every image on a single release paper.

Furthermore, according to the printer of the present invention, the half-cutting means comprises a plurality of cutters that are disposed at a predetermined interval along the width direction and that is vertically movable, and moving means that vertically moves the cutters independently of each other, the moving means moving the cutters selected according to the widthwise dimension of the image printed by the printing means, from a first position where the cutters have been evacuated from the printing medium to a second position where the cutters are to cut off the printing portion of the printing medium except for the release portion. Thereby, half-cutting according to the dimension of a printed image in the width direction can be applied to the roll-shaped printing medium.

Moreover, according to the printer of the present invention, since a rotatably supported pressing roller that presses the printing medium is disposed on at least one of the upstream side and the downstream side of the plurality of cutters in the conveying direction, it is possible to prevent the lifting-off of the printing medium from the conveying surface, and thereby achieve high-accuracy half-cutting.

Also, according to the printer of the present invention, since a second half-cutting means is provided that cuts off the printing portion of the printing medium except for the release portion, along the width direction, it is possible to produce precut seals in which half-cutting is performed not only along the conveying direction but also along the width direction for every image on a single release paper.

According to the roll-shaped printing medium of the present invention, there are provided a printing surface on which images are to be printed, a printing portion that is releasably adhered, and a release portion for holding the adhered printing portion, the printing portion having been cut off in advance along the conveying direction of the image printed by the printing means, at the interval corresponding to the dimension of the image in the width direction perpendicular to the conveying direction. This makes it possible to reliably prevent the possibility that the seal portion peels off before printing, and produce precut seals without the need for the printer to detect the position of the roll-shaped printing medium in the conveying direction.

While the present invention has been described with reference to what are at present considered to be the preferred embodiments, it is to be understood that various changes and modifications may be made thereto without departing from the present invention in its broader aspects and therefore, it is intended that the appended claims cover all such changes and modifications that fall within the true spirit and scope of the invention.

What is claimed is:

1. A printer that uses a roll-shaped printing medium formed by winding, into a roll shape, a printing medium including a printing surface on which images are to be printed, a releasably adhered printing portion, and a release portion for holding said adhered printing portion, said printer comprising:

conveying means that conveys said printing medium while pulling out said printing medium by a predetermined amount every time an image is to be printed;

printing means that prints an image with respect to the printing medium conveyed by said conveying means;

half-cutting means that cuts off the printing portion of said printing medium except for said release portion, along the conveying direction of the image printed by said printing means, at the interval corresponding to the dimension of said image in the width direction perpendicular to said conveying direction; and cutting means that cuts said printing medium along the width direction of the image printed by said printing means, at the positions corresponding to the dimension in the conveying direction of the image.

2. A printer according to claim 1, wherein said printing means prints a plurality of the same or mutually different images along said width direction.

3. A printer according to claim 1, wherein said half-cutting means comprising:

a plurality of cutters that are disposed at a predetermined interval along said width direction and that is vertically movable; and moving means that vertically moves said cutters independently of each other;

wherein said moving means moves the cutters selected according to the widthwise dimension of the image printed by said printing means, from a first position at which said cutters have been evacuated from said printing medium to a second position at which said cutters are to cut off the printing portion of said printing medium except for said release portion.

4. A printer according to claim 3, further comprising a rotatably supported pressing roller that presses said printing medium, said pressing roller is disposed on at least one of the upstream side and the downstream side of said plurality of cutters in the conveying direction.

5. A printer according to claim 1, further comprising second half-cutting means disposed on the upstream side in the conveying direction of said cutting means, said half-cutting means cutting off the printing portion of said printing medium except for said release portion, along said width direction of the image printed by said printing means, at the positions corresponding to the dimension of the image in said conveying direction.

* * * * *